US006019670A

United States Patent [19]

Cheng et al.

[11] Patent Number: 6,019,670

[45] Date of Patent: Feb. 1, 2000

[54] METHOD AND APPARATUS FOR CONDITIONING A POLISHING PAD IN A CHEMICAL MECHANICAL POLISHING SYSTEM

[75] Inventors: Tsungnan Cheng, Saratoga; Shou-Chen Kao; Michael T. Sherwood, both of Fremont, all of Calif.

[73] Assignee: Applied Materials, Inc., Santa Clara, Calif.

[21] Appl. No.: 08/814,436

[22] Filed: Mar. 10, 1997

(Under 37 CFR 1.47)

[51] Int. Cl.[7] ..... B24B 7/00

[52] U.S. Cl. ..... 451/56; 451/41; 451/286; 451/288; 451/443

[58] Field of Search ..... 451/41, 56, 57, 451/63, 285, 286, 287, 288, 397, 398, 443, 444

[56] References Cited

U.S. PATENT DOCUMENTS

| | | | |
|---|---|---|---|
| 5,081,051 | 1/1992 | Mattingly et al. | 437/10 |
| 5,216,843 | 6/1993 | Breivogel et al. | 51/131.1 |
| 5,433,650 | 7/1995 | Winebarger | 451/6 |
| 5,456,627 | 10/1995 | Jackson et al. | 451/11 |
| 5,486,131 | 1/1996 | Cesna et al. | 451/56 |
| 5,569,062 | 10/1996 | Karlsrud | 451/285 |
| 5,681,212 | 10/1997 | Hayakawa et al. | 451/288 |

FOREIGN PATENT DOCUMENTS

| | | | |
|---|---|---|---|
| 0674972 A1 | 4/1995 | European Pat. Off. | B24B 37/04 |

*Primary Examiner*—Eileen P. Morgan
*Attorney, Agent, or Firm*—Fish & Richardson

[57] ABSTRACT

A chemical mechanical polishing apparatus including a carrier head having an integral conditioning member is described. The conditioning member includes a conditioning surface that may selectively be moved into contact with a polishing surface of a polishing pad. The conditioning member may be connected to a surface of the carrier's retaining ring assembly. As a result, the polishing surface may be conditioned either continuously or intermittently when a substrate is loaded in the carrier for polishing.

19 Claims, 9 Drawing Sheets

METHOD AND APPARATUS FOR CONDITIONING A POLISHING PAD IN A CHEMICAL MECHANICAL POLISHING SYSTEM

BACKGROUND OF THE INVENTION

The present invention relates generally to chemical mechanical polishing of substrates, and more particularly to a conditioner for a polishing pad which is connected with a carrier head in a chemical mechanical polishing system.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly more non-planar. This non-planar outer surface presents a problem for the integrated circuit manufacturer. If the outer surface of the substrate is non-planar, then a photoresist layer placed thereon is also non-planar. A photoresist layer is typically patterned by a photolithographic apparatus that focuses a light image onto the photoresist. If the outer surface is sufficiently non-planar, then the maximum height difference between the peaks and valleys of the outer surface may exceed the depth of focus of the imaging apparatus. It may then be impossible to properly focus the light image onto the entire outer surface.

It may be prohibitively expensive to design new photolithographic devices having an improved depth of focus. In addition, as the feature size used in integrated circuits becomes smaller, shorter wavelengths of light may have to be used, resulting in further reduction of the available depth of focus. Therefore, there is a need to periodically planarize the substrate surface to provide a planar surface.

Chemical mechanical polishing is one accepted method of planarization. This planarization method typically requires that the substrate be mounted on a carrier head or polishing head. The exposed surface of the substrate is then placed against a rotating polishing pad. The carrier provides a controllable load, i.e., pressure, on the substrate to push it against the polishing pad. In addition, the carrier may rotate to provide additional motion between the substrate and polishing surface. A polishing slurry, including an abrasive and at least one chemically-reactive agent, is supplied to the polishing pad to provide an abrasive chemical solution at the interface between the pad and substrate.

Chemical mechanical polishing is a fairly complex process, and it differs from simple wet sanding. In a chemical mechanical polishing process, a reactive agent in the slurry reacts with the outer surface of the substrate to form reactive sites. The interaction of the polishing pad and abrasive particles at the reactive sites on the substrate results in polishing.

An effective chemical mechanical polishing process has a high polishing rate and generates a substrate surface which is finished (lacks small-scale roughness) and flat (lacks large-scale topography). The polishing rate, finish and flatness are determined by the pad and slurry combination, the relative speed between the substrate and pad, and the force pressing the substrate against the pad. Because inadequate flatness and finish can create defective substrates, the selection of a polishing pad and slurry combination is usually dictated by the required finish and flatness. Given these constraints, the polishing time needed to achieve the required finish and flatness sets the maximum throughput of the polishing apparatus.

An additional limitation on polishing throughput is "glazing" of the polishing pad. Glazing occurs when the polishing pad is heated and compressed in regions where the substrate is pressed against it. The peaks of the polishing pad are pressed down and the pits of the polishing pad are filled-up, so the polishing pad surface becomes smoother and less abrasive. As a result, the polishing time required to polish a substrate increases. Therefore, the polishing pad surface must be periodically returned to an abrasive condition, or "conditioned", to maintain a high throughput.

An additional consideration in the production of integrated circuits is process and product stability. To achieve a high yield, i.e., a low defect rate, each successive substrate should be polished under substantially similar conditions. Each substrate, in other words, should be polished approximately the same amount so that each integrated circuit is substantially identical.

In view of the foregoing, there is a need for a chemical mechanical polishing apparatus which increases polishing throughput while providing the desired surface flatness and finish. Such a chemical mechanical polishing apparatus should include an apparatus and provide a method for conditioning the polishing pad.

SUMMARY OF THE INVENTION

In general, in one aspect, the invention features an apparatus for use in a chemical mechanical polishing system. The apparatus comprises a carrier for holding a substrate on a polishing surface and a conditioning surface formed as part of the carrier.

In general, in another aspect, the invention features a method of conditioning a polishing surface in a chemical mechanical polishing system. A carrier assembly presses a surface of a substrate against the polishing surface, and a conditioning surface of the carrier assembly simultaneously is pressed against the polishing surface to condition the polishing surface.

In general, in another aspect, the invention features a carrier head for holding a substrate on a polishing surface. The carrier head comprises a housing assembly and a conditioning member adapted to condition the polishing surface. In some embodiments, the conditioning surface may be positioned either in a first position wherein the conditioning surface does not contact the polishing surface or in a second position wherein the conditioning surface contacts the polishing surface. The conditioning member also may be connected to a retaining ring assembly of the carrier head.

In general, in another aspect, the invention is directed to a conditioner. The conditioner comprises a conditioning surface adapted to condition a polishing surface as the polishing surface polishes a substrate, and a channel formed in the conditioning surface to permit the distribution of slurry to the substrate.

In general, in another aspect, the invention is directed to a retaining apparatus for use in a chemical mechanical polishing system. The retaining apparatus includes a first surface adapted to hold the substrate in position against the polishing surface and a second surface adapted to condition the polishing surface.

In general, in another aspect, the invention is directed to a method of operating a chemical mechanical polishing system. The method includes polishing a substrate with a polishing surface and conditioning the polishing surface while it is polishing the substrate.

Implementations of the invention may include the following features. The apparatus may include a positioning member adapted to move the conditioning surface between a first position not in contact with the polishing surface and a second position in contact with the polishing surface. The apparatus may include one or more biasing mechanisms, such as an inflatable membrane or bellows to urge the conditioning surface into contact with the polishing surface and a spring assembly to urge the conditioning surface away from the polishing surface. There may be a slick bearing surface disposed between the positioning member and the carrier. The conditioning surface may extend around the perimeter of the carrier. The carrier may include a rotation restricting member, such as a key and keyway connection between the carrier and the positioning member.

Advantages of the invention may include the following. The surface of the polishing pad will be worn more thoroughly and uniformly, so glazing will be removed more effectively. The edges of the pad also will be worn more effectively, reducing or eliminating unwanted "edge effects" often caused by uneven wear between the center of the pad and its outermost regions. The pad may be conditioned while it polishes a substrate. As a result, substrates will be polished with increased throughput and uniformity.

Other advantages of the invention will be set forth in the description which follows, and in part will be obvious from the description, or may be learned by practice of the invention. The advantages of the invention may be realized by means of the instrumentalities and combinations particularly pointed out in the claims.

BRIEF DESCRIPTION OF THE DRAWINGS

The accompanying drawings, which are incorporated in and constitute a part of the specification, schematically illustrate embodiments of the invention, and together with the general description given above and the detailed description of the embodiments given below, serve to explain the principles of the invention.

DESCRIPTION OF THE PREFERRED EMBODIMENT(S)

Figure 1:
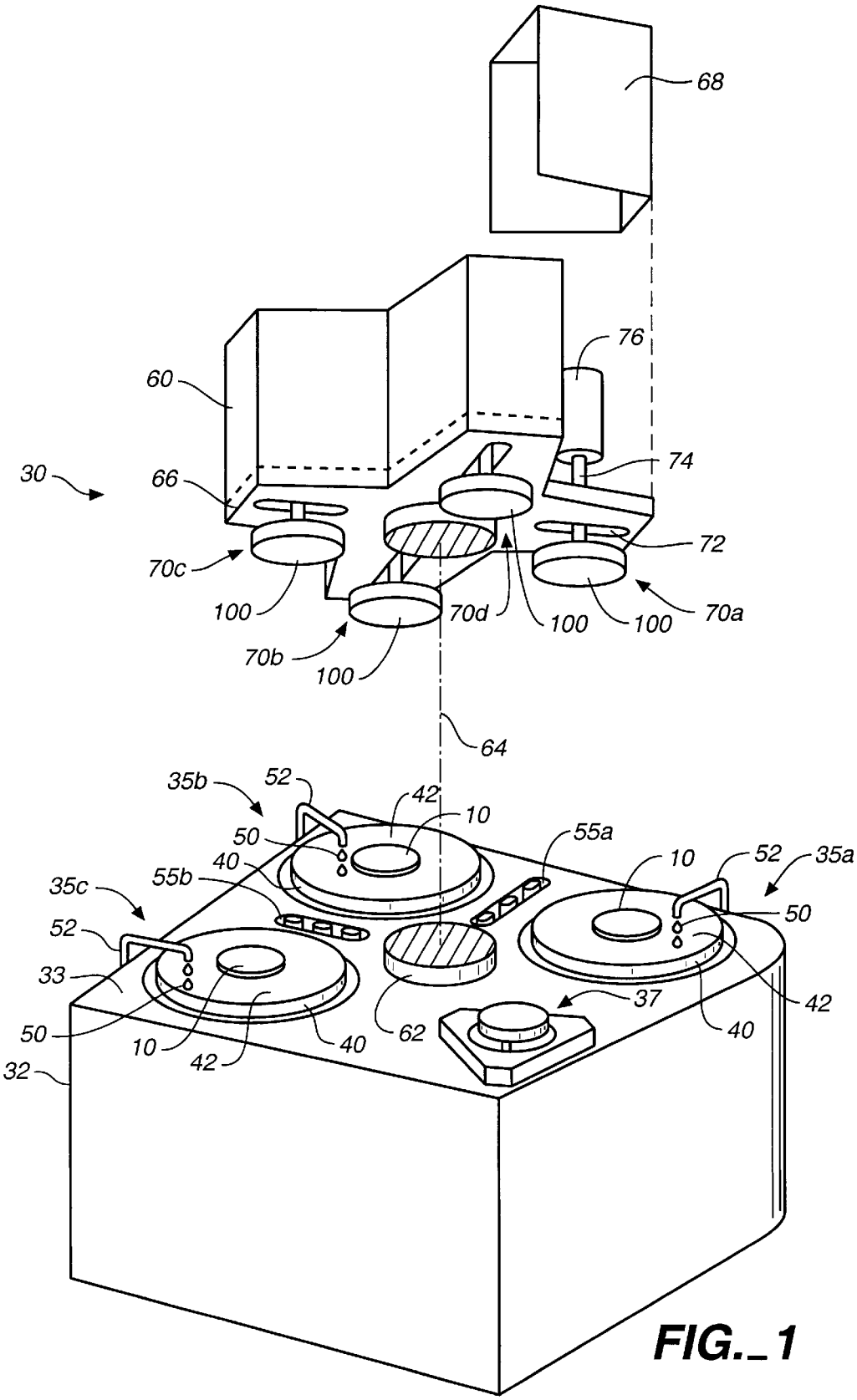
FIG. 1 is a schematic exploded perspective view of a chemical mechanical polishing apparatus.

Referring to FIG. 1, a chemical mechanical polishing (CMP) apparatus 30 in which the present invention may be used is shown. The CMP apparatus 30 includes a lower machine base 32 with a table top 33 mounted thereon and a removable upper outer cover (not shown). Table top 33 supports a series of polishing stations 35*a*, 35*b* and 35*c*, and a transfer station 37. Transfer station 37 forms a generally square arrangement with polishing stations 35*a*, 35*b* and 35*c*. Transfer station 37 serves multiple functions, including receiving individual substrates 10 from a loading apparatus (not shown), washing the substrates, loading the substrates into carrier or polishing heads 100 (to be described below), receiving the substrates from the carriers, washing the substrates again, and finally transferring the substrates back to the loading apparatus. Additional details of the station and apparatus of CMP apparatus 30 may be found in U.S. application Ser. No. 08/549,336, filed Oct. 27, 1995, by Ilya Perlov, et al., entitled RADIALLY OSCILLATING CAROUSEL PROCESSING SYSTEM FOR CHEMICAL MECHANICAL POLISHING, and assigned to the assignee of the present invention, the entire disclosure of which is incorporated by reference.

Each polishing station 35*a*–35*c* includes a rotatable platen 40 having a polishing pad 42. A slurry 50 containing a reactive agent (e.g., deionized water for oxide polishing), abrasive particles (e.g., silicon dioxide for oxide polishing) and a chemically-reactive catalyzer (e.g., potassium hydroxide for oxide polishing) is supplied to the surface of polishing pad 42 by a slurry supply tube 52. Sufficient slurry is provided to cover and wet the entire polishing pad 42. Two or more intermediate washing stations 55*a* and 55*b* may be positioned between neighboring polishing stations 35*a*, 35*b* and 35*c*. The washing stations rinse the substrates as they pass from one polishing station to another.

A rotatable multi-head carousel 60 is positioned above lower machine base 32. Carousel 60 is supported by a center post 62 and rotated thereon about a carousel axis 64 by a carousel motor assembly located within base 32. Center post 62 supports a carousel support plate 66 and a cover 68. Multi-head carousel 60 includes four carrier head systems 70*a*, 70*b*, 70*c*, and 70*d*. Three of the carrier head systems receive and hold substrates, and polish them by pressing them against polishing pads 42 on platens 40 of polishing stations 35*a*–35*c*. One of the carrier head systems receives a substrate from and delivers the substrate to transfer station 37.

The four carrier head systems 70*a*–70*d* are mounted on carousel support plate 66 at equal angular intervals about carousel axis 64. Center post 62 allows the carousel motorto rotate the carousel support plate 66 and to orbit the carrier head systems 70*a*–70*d* and the substrates attached thereto, about carousel axis 64.

Each carrier head system 70*a*–70*d* includes a carrier or carrier head 100. Each carrier head 100 independently rotates about its own axis, and independently laterally oscillates in a radial slot 72 formed in carousel support plate 66. Oscillation through the radial slot 72 allows the carrier head 100 to move the substrate 10 across the surface of polishing pad 42. A carrier drive shaft 74 connects a carrier head rotation motor 76 to carrier head 100 (shown by the removal of one-quarter of cover 68). There is one carrier drive shaft and motor for each head.

Figure 2:
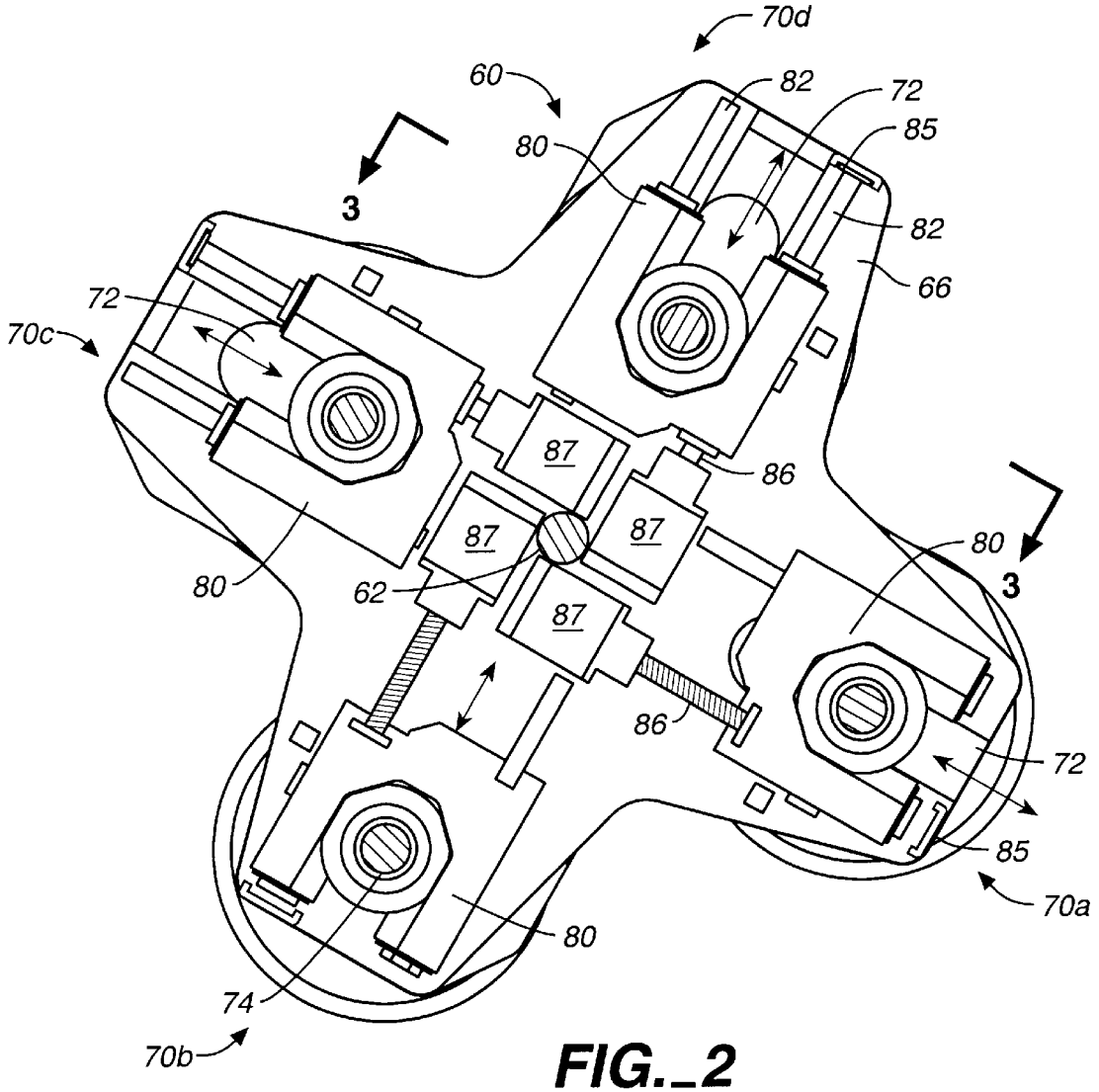
FIG. 2 is a schematic top view of a carousel of the chemical mechanical polishing apparatus, with the upper housing removed.

As shown in FIG. 2, in which entire cover 68 of carousel 60 has been removed, carousel support plate 66 supports the four carrier head systems 70*a*–70*d* not labeled in FIG. The carousel support plate includes four radial slots 72, generally extending radially and oriented 90° apart. Radial slots 72 may either be close-ended (as shown) or open-ended. The top of support plate supports four slotted carrier head support slides 80. Each slide 80 aligns along one of the radial slots 72 and moves freely along a radial path with respect to carousel support plate 66. Two linear bearing assemblies 71*a*–71*b* (FIG. 3) bracket each radial slot 72 to support each slide 80.

Figure 3:
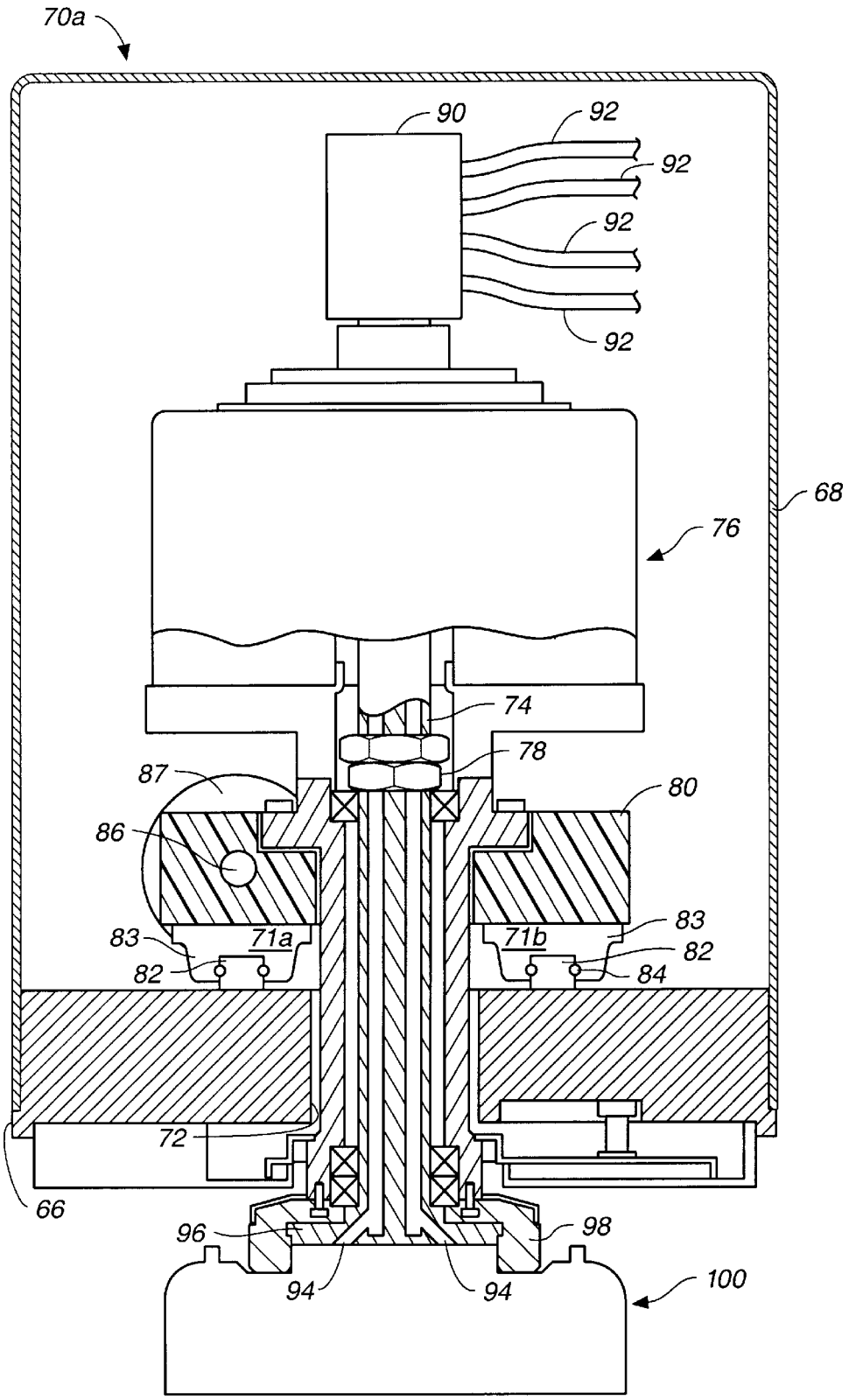
FIG. 3 is a cross-sectional view of the carousel of FIG. 2 along line 3—3.

As shown in both FIGS. 2 and 3, each linear bearing assembly 71*a*–71*b* includes a rail 82 fixed to carousel support plate 66 and two hands 83 (only one of which is illustrated per linear bearing assembly 71*a*–71*b* in FIG. 3) fixed to slide 80 to grasp the rail. Bearings 84 separate each hand 83 from rail 82 to provide free and smooth movement therebetween. Thus, the linear bearing assemblies permit the slides 80 to move freely along radial slots 72.

A bearing stop 85 anchored to the outer end of one of the rails 82 prevents slide 80 from accidentally coming off the end of the rails. One of the arms of each slide 80 contains an unillustrated threaded receiving cavity or nut fixed to the slide near its distal end. The threaded cavity or nut receives a worm-gear lead screw 86 driven by a slide radial oscillator motor 87 mounted on carousel support plate 66. When motor 87 turns lead screw 86, slide 80 moves radially. The four motors 87 are independently operable to independently move the four slides along the radial slots 72 in carousel support plate 66.

Each carrier head system includes a carrier head assembly fixed to each of the four slides. Each carrier head assembly includes carrier head 100, carrier drive shaft 74, carrier motor 76, and a surrounding non-rotating shaft housing 78. Drive shaft housing 78 holds drive shaft 74 by paired sets of lower ring bearings and a set of upper ring bearings. Each carrier head assembly can be assembled away from polishing apparatus 30, slid in its untightened state into radial slot 72 in carousel support plate 66 and between the arms of slide 80, and there tightened to grasp the slide.

A rotary coupling 90 at the top of drive motor 76 couples four fluid or electrical lines 92 into four passages or channels 94 in drive shaft 74 (only two channels are shown because FIG. 3 is a cross-sectional view). Passages 94 may be angled through a base flange 96 of drive shaft 74 to connect to receiving channels or passageways 126 (FIG. 4) in carrier head 100. As explained in more detail below, a threaded perimeter nut 98 may placed over flange 96 to connect drive shaft 74 to carrier head 100. Channels 94 are used, as described in more detail below, to pneumatically power carrier head 100, to actuate a retaining ring against the polishing pad, to actuate a conditioning ring against the polishing pad, and to vacuum-chuck the substrate to the carrier head.

Returning to FIG. 1, the substrates attached to the bottom of carrier heads 100 may be raised or lowered by the carrier head systems 70*a*–70*d*. An advantage of the overall carousel system is that only a short vertical stroke is required of the polishing head systems to accept substrates, and position them for polishing and washing. An input control signal (e.g., a pneumatic, hydraulic or electrical signal) causes expansion or contraction of carrier head 100 of the polishing head systems in order to accommodate any required vertical stroke. Specifically, the input control signal causes a lower carrier member having a wafer receiving recess to move vertically relative to a stationary upper carrier member.

During actual polishing, three of the carrier heads, e.g., those of polishing head systems 70*a*–70*c*, are positioned at and above respective polishing stations 35*a*–35*c*. As noted, each rotatable platen 40 supports a polishing pad 42 with a top surface which is wetted with an abrasive slurry. Carrier head 100 lowers a substrate to contact polishing pad 42, and slurry 50 acts as the media for chemical mechanical polishing of the substrate or wafer.

If substrate 10 is an eight-inch (200 mm) diameter disk, then platen 40 and polishing pad 42 will be about twenty inches in diameter. Platen 40 is preferably a rotatable aluminum or stainless steel plate connected by stainless steel platen drive shaft (not shown) to a platen drive motor (not shown). For most polishing processes, the drive motor rotates platen 40 at thirty to two-hundred revolutions per minute, although lower or higher rotational speeds may be used.

Figure 4:
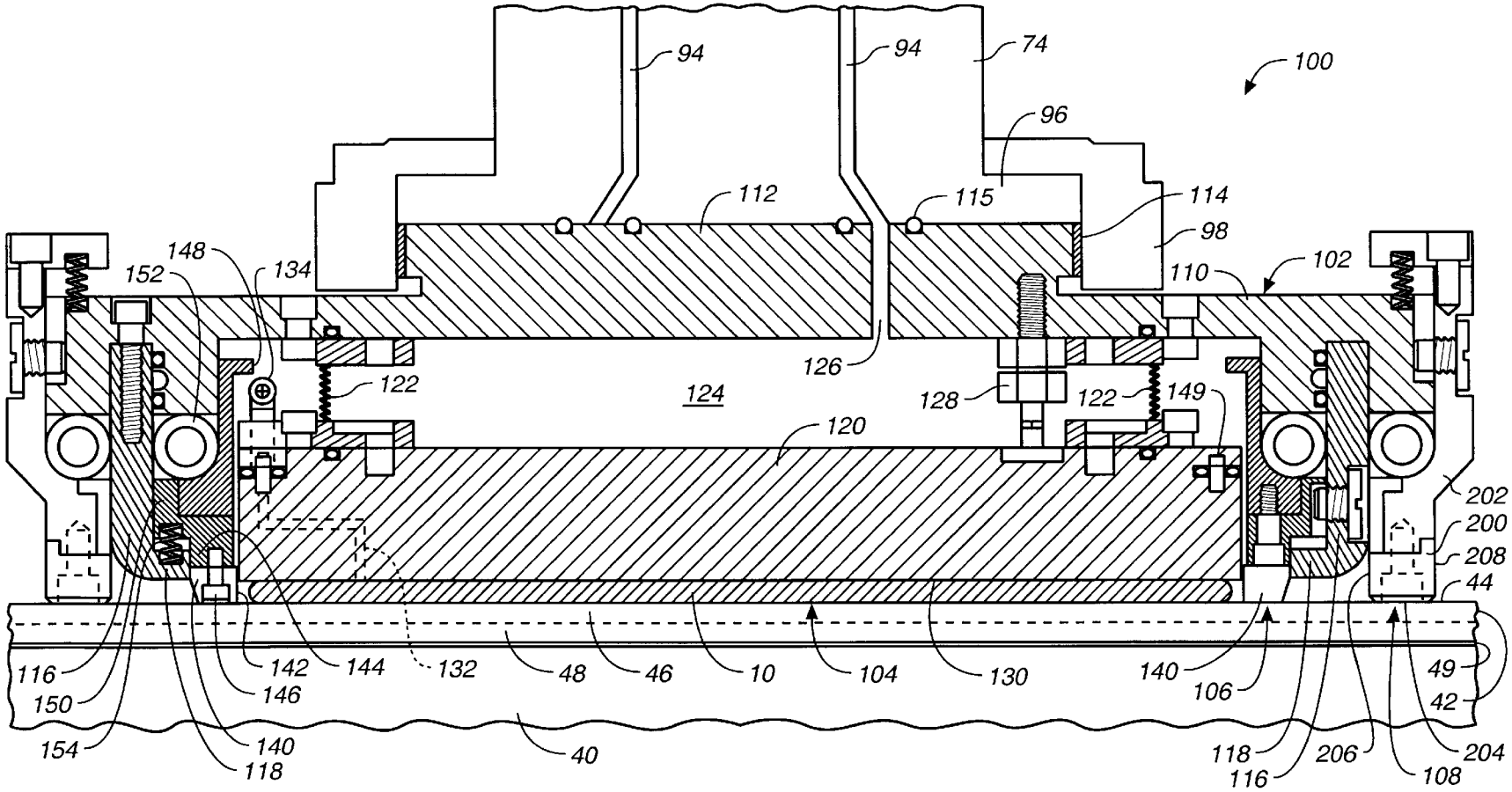
FIG. 4 is a schematic cross-sectional view of a carrier including a conditioning apparatus in accordance with the present invention.

Referring to FIG. 4, polishing pad 42 may comprise a hard composite material having a roughened polishing surface 44. Polishing pad 42 may be a two-layer pad in which the upper layer 46 is harder than the lower layer 48. The lower layer is attached to platen 40 by a pressure-sensitive adhesive layer 49. The polishing pad 42 may be a fixed-abrasive pad or a non-fixed abrasive pad. Though a fixed abrasive pad generally does not need to be conditioned, some passivation may occur if the pad is not conditioned properly.

If polishing pad 42 is a non-fixed abrasive pad, the upper layer typically comprises a material composed of polyurethane mixed with a filler material and typically is approximately fifty mils thick. The lower layer typically comprises a material composed of compressed felt fibers leached with urethane and also is approximately fifty mils thick. A two-layer non-fixed abrasive polishing pad, with the upper layer composed of IC-1000 and the lower layer composed of SUBA-4, is available from Rodel, Inc., Newark, Del. (IC-1000 and SUBA-4 are product names of Rodel, Inc.).

If polishing pad 42 is a fixed abrasive pad, upper layer 46 typically will be a 5–200 mil thick abrasive composite layer, composed of abrasive grains held in a binder material. Lower layer 48 typically will be a 25–200 mil thick backing layer, composed of a material such as a polymeric film, paper, cloth, a metallic film, or the like. Fixed abrasive polishing pads are described in detail in the following U.S. Pat. Nos., all of which are incorporated by reference: 5,152,917, issued on Oct. 6, 1992, and entitled STRUCTURED ABRASIVE ARTICLE; 5,342,419, issued on Aug. 30, 1994, and entitled ABRASIVE COMPOSITES HAVING A CONTROLLED RATE OF EROSION, ARTICLES INCORPORATING SAME, AND METHODS OF MAKING AND USING SAME; 5,368,619, issued on Nov. 29, 1994, and entitled REDUCED VISCOSITY SLURRIES, ABRASIVE ARTICLES MADE THEREFROM AND METHODS OF MAKING SAID ARTICLES; and 5,378,251, issued on Jan. 3, 1995, and entitled ABRASIVE ARTICLES AND METHODS OF MAKING AND USING SAME.

The carrier head uniformly loads the substrates against the polishing pad. For the main polishing step, usually performed at station 35*a*, carrier head 100 applies a force of approximately two to ten pounds per square inch (psi) to substrate 10. At subsequent stations, carrier head 100 may apply more or less force. For example, for a final polishing step, usually performed at station 35*c*, carrier head 100 may apply a force of approximately one to three psi. A separate carrier motor 76 (see FIG. 1) rotates each carrier head 100 at about thirty to two-hundred revolutions per minute. Platen 40 and carrier head 100 may rotate at substantially the same rate.

Generally, each carrier head 100 loads the substrate against polishing pad, transfers torque from the drive shaft to rotate the substrate, ensures that the substrate does not slip out from beneath the carrier head during polishing operations, and conditions the surface of the polishing pad. As shown in FIG. 4, each carrier head 100 includes four major assemblies: a housing assembly 102, a carrier assembly 104, a retaining ring assembly 106, and a conditioning assembly 108.

The housing assembly 102 includes a disk-shaped housing support plate 110 which is fixed to or formed integral with drive shaft 74. The housing support plate 110 is generally circular in shape so as to match the circular configuration of a substrate to be polished. The top surface of housing support plate 110 includes a cylindrical hub 112 having a threaded neck 114. Threaded perimeter nut 98 can be screwed onto threaded neck 114 to connect carrier head 100 to drive shaft 74. Two or more dowel pins (not shown) fit into dowel pin holes (not shown) in flange 96. The dowel pins transfer torque from the drive shaft to housing assembly support plate 110 so the housing assembly rotates with the drive shaft. In addition, the dowel pins align channels 94 in drive shaft 74 to passages 126 (only one of which is shown in FIG. 4) in carrier head 100. A fluid tight connection may be made between channels 94 in drive shaft 74 and conduits 126 by O-rings 115.

A cylindrical wall 116 extends from the bottom of housing support plate 110. The wall 116 includes a lower lip portion 118 which curves inwardly toward the substrate. The wall 116 encloses carrier assembly 104 and retaining ring assembly 106.

The carrier assembly 104 includes a substrate backing member 120 which is attached to housing support plate 110 by a cylindrical bellows 122. The bellows create a bellows chamber 124 forming a vertically movable vacuum seal. Substrate backing member 120 and bellows 122 may be made of stainless steel. The bellows 122 expand and contract so that substrate backing member 120 can move vertically relative to housing assembly 102. To this end, bellows chamber 124 can be pressurized positively or negatively through a passageway 126 which connects the bellows chamber to a pressure or vacuum source (not shown) via passageway 94. By positively pressurizing bellows chamber 124, a downward force is exerted on substrate backing member 120, and thus on substrate 10, to press the substrate against the polishing surface of the polishing pad. By negatively pressurizing bellows chamber 124, the substrate backing member and substrate are lifted away from the polishing pad. The carrier head may include one or more stops 128 spaced circumferentially around the perimeter of bellows chamber 124 to halt the upward motion of the substrate backing member.

The bottom surface of substrate backing member 120 includes a substrate receiving face 130. At least one vacuum-chucking conduit 132 extends from substrate receiving face 130 through substrate backing member 120 to a fitting 134. The fitting 134 is connected by a flexible fluid connector (not shown) to a conduit (also not shown) in housing support plate 110. The conduit in housing support plate 110 is, in turn, connected to one of the passageways 94 in drive shaft 74. A pump (not shown) is connected by the passageway, conduit, connector, and fitting to the vacuum-chucking conduit. If a negative pressure is applied to the vacuum-chucking conduit, the substrate will be vacuum-chucked to receiving face 130. If an adequate positive pressure is applied to the vacuum-chucking conduit, the substrate will be ejected from receiving face 130.

As the polishing pad rotates, it tends to pull the substrate out from beneath the carrier head. Therefore, retaining ring assembly 106 includes a downwardly-projecting retaining ring 140 which extends circumferentially around the edge of the substrate. The retaining ring 140 forms a recess which contains the substrate. More specifically, an inner edge 142 of retaining ring 140 prevents the substrate from being dragged out from beneath backing member 120.

The retaining ring 140 is attached to a backing ring 144 to hold the retaining ring in place. The retaining ring includes counter-bored through-holes through which screws 146 extend. The screws are threaded into corresponding threaded holes in backing ring 144 to hold the retaining ring. The retaining ring 140 may be made of a plastic material, and backing ring 144 may be made of aluminum. The backing ring 144 may have an inner flange 148 which extends inwardly and over substrate backing member 120. When substrate backing member 120 is lifted away from the polishing pad, a top surface 149 of the substrate backing member contacts inner flange 148 to also lift retaining ring assembly 106. The backing ring 144 also includes an outer flange 150 which extends outwardly over lower lip 118. An expandable annular bladder 152 fits between the top face of outer flange 150 and the bottom surface of housing support plate 110 and surrounds inner flange 148. A pump (not shown) is connected to bladder 152 via conduits 94 in drive shaft 74 and housing support plate 110 to pressurize the bladder. Six to twelve compression springs 154 are located between the bottom face of outer flange 150 and the top surface of lower lip 118.

The backing ring 144 and retaining ring 140 are maintained in a relatively fixed position relative to lower lip 118 by compression springs 154, but when bladder 152 is pressurized, retaining ring 140 is forced downwardly into contact with polishing pad 42. In this position, the retaining ring surrounds the edge of substrate 10, and prevents the substrate from sliding out from under substrate backing member 120 during the polishing operation.

A continuously pressurized bladder could replace the compression springs. Alternately, pressurized bellows could replace both compression springs 154 and bladder 152. The retaining ring can also be mounted to the backing ring without screws, such as by use of keys and key slots.

As mentioned above, polishing pad 42 becomes "glazed" during the chemical mechanical polishing process. This glazing effect is caused primarily by two phenomena: accumulation of spent slurry in the porous surface of the polishing pad (primarily with non-fixed abrasive pads), and compression of this surface due to the loading and shear forces imposed on the pad during polishing. A glazed polishing pad has a lower coefficient of friction, and thus polishes at a substantially lower rate, than a "fresh" or unglazed pad. As the polishing rate drops, the time required to polish a substrate increases; thus, the throughput of substrates through the CMP apparatus decreases. In addition, because the polishing pad becomes slightly more glazed after each successive polishing operation, it polishes each successive substrate differently. Therefore, the polishing pad must be periodically conditioned to provide a consistently rough pad surface.

The conditioning process physically abrades the polishing surface of a polishing pad to restore its roughness. This abrasion "wears" the pad; i.e., it removes material from the surface of the polishing pad. If the conditioning process removes more material from the polishing pad in some regions than in others, the wear on the polishing pad will be non-uniform. When the outer surface of a substrate is pressed against a non-uniform polishing pad, the thinner areas of the polishing pad are compressed less than the thicker areas; therefore, they exert less pressure on the substrate. Consequently, the thinner areas of the polishing pad will polish at a slower rate than the thicker areas, and the non-uniform thickness of a polishing pad may generate a non-uniform substrate layer. Therefore, it is desirable to provide a conditioning apparatus which wears the polishing pad evenly to create a substantially planar, although rough, polishing surface 44.

Conditioning assembly or conditioner 108 is mounted about the periphery of housing assembly 102. The conditioning assembly includes a conditioning ring 200 which is positionable on polishing surface 44 and a positioning mechanism 202 which connects conditioning ring 200 to housing assembly 102. Although illustrated as circular in shape, conditioning ring 200 may have other shapes. Alternatively, the conditioning ring 200 may connect to other assemblies of the carrier head, such as carrier assembly 104 or retaining ring assembly 106, as described below. As noted, the conditioning assembly is part of the carrier head.

Figure 6:
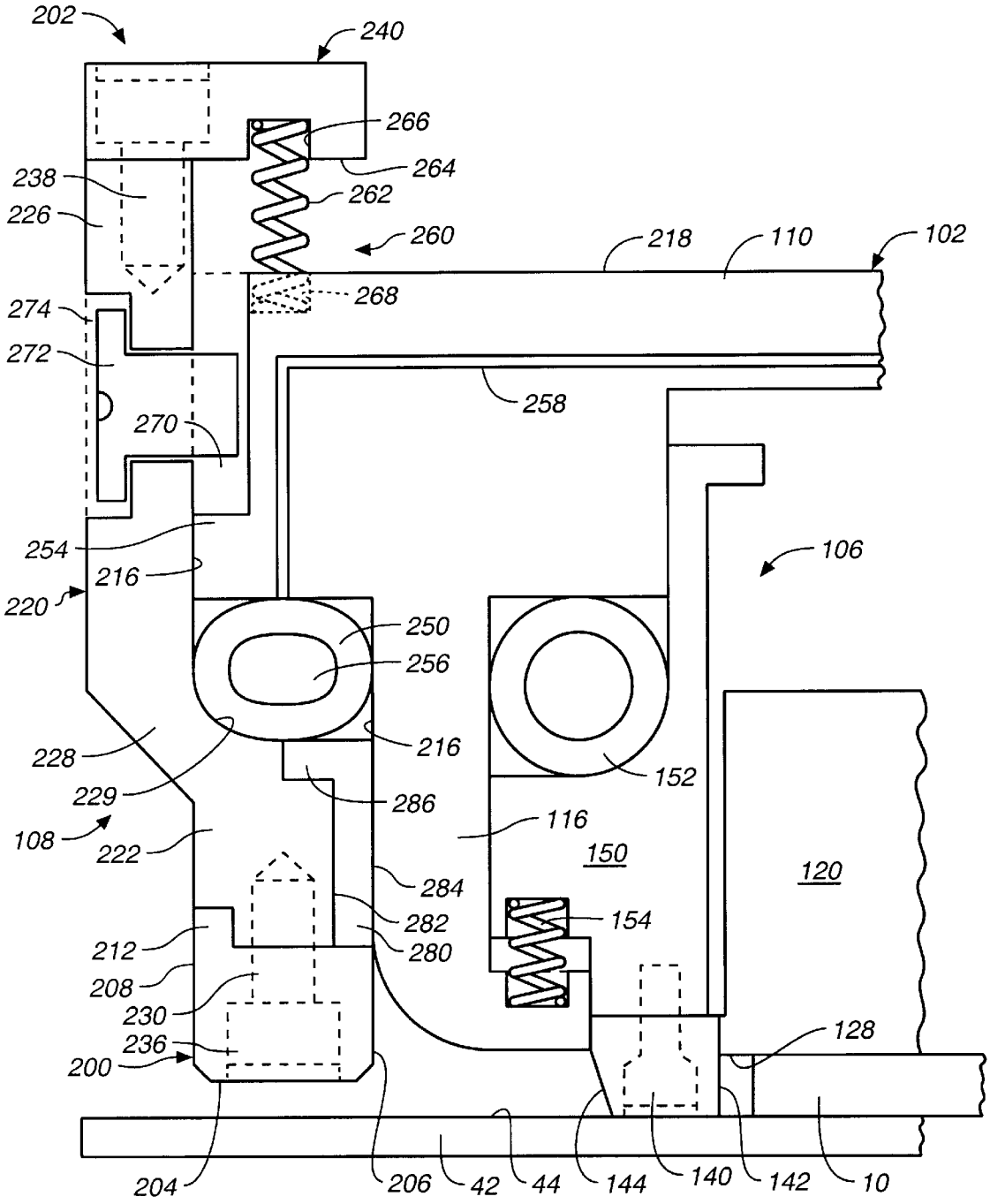
FIG. 6 is a cross-sectional view of a portion of the carrier of FIG. 4 in which the conditioning apparatus is in a retracted position vis-a-vis the polishing pad.
Figure 7:
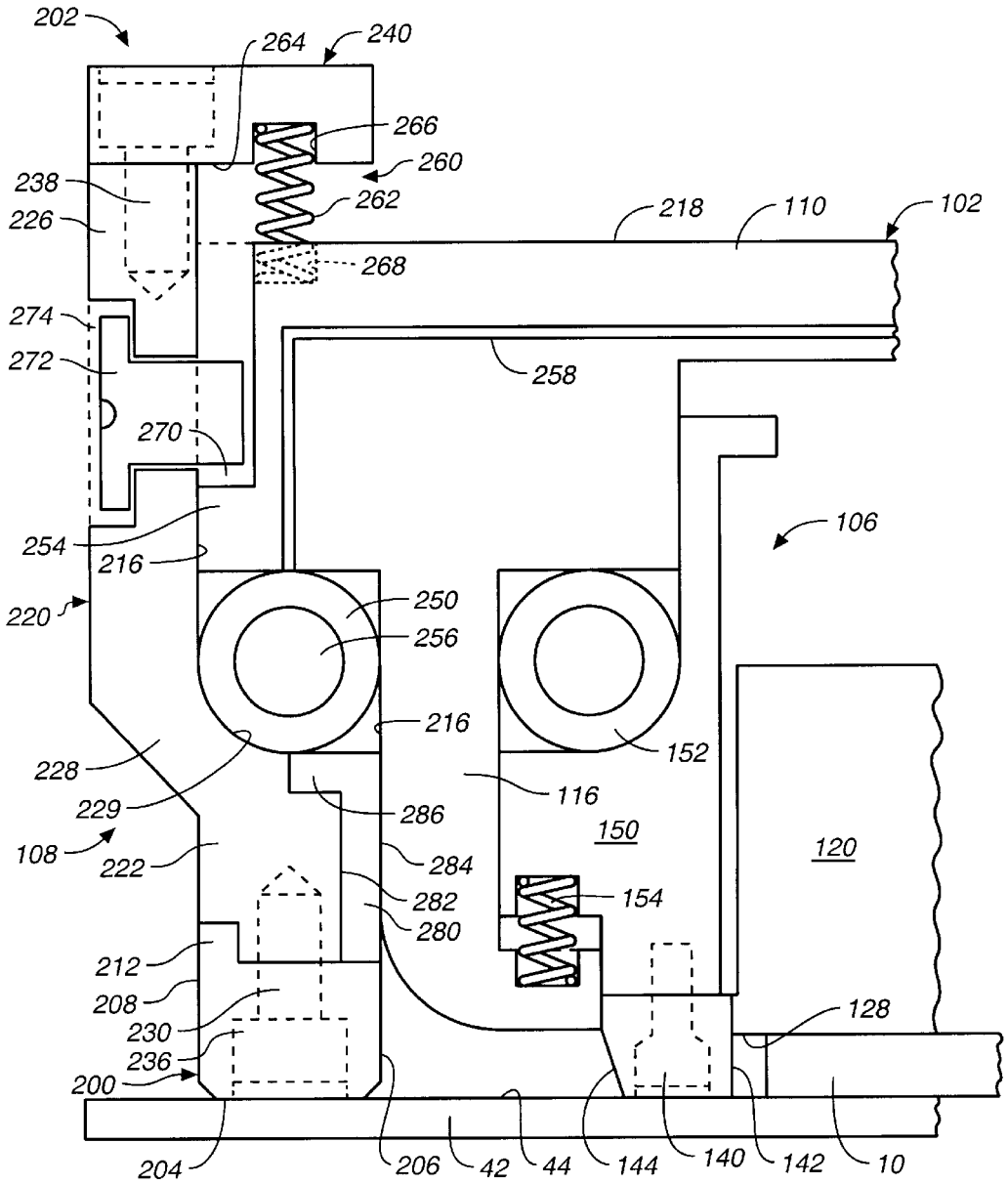
FIG. 7 is a cross-sectional view of a portion of the carrier of FIG. 4 in which the conditioning apparatus is in contact with the polishing pad.

Positioning mechanism 202 positions conditioning ring 200 relative to polishing surface 44. Specifically, the positioning mechanism allows the conditioning ring to move between a retracted position where the conditioning ring is not in contact with the polishing surface, as shown in FIG. 6, and an extended position where the conditioning ring is in contact with the polishing surface, as shown in FIG. 7. Positioning mechanism 202 may position the conditioning ring 200 in contact with the polishing surface 44 while the substrate 10 is positioned on the polishing surface 44, or the substrate 10 and the conditioning ring 200 may contact the polishing surface 44 at different times.

Figure 5:
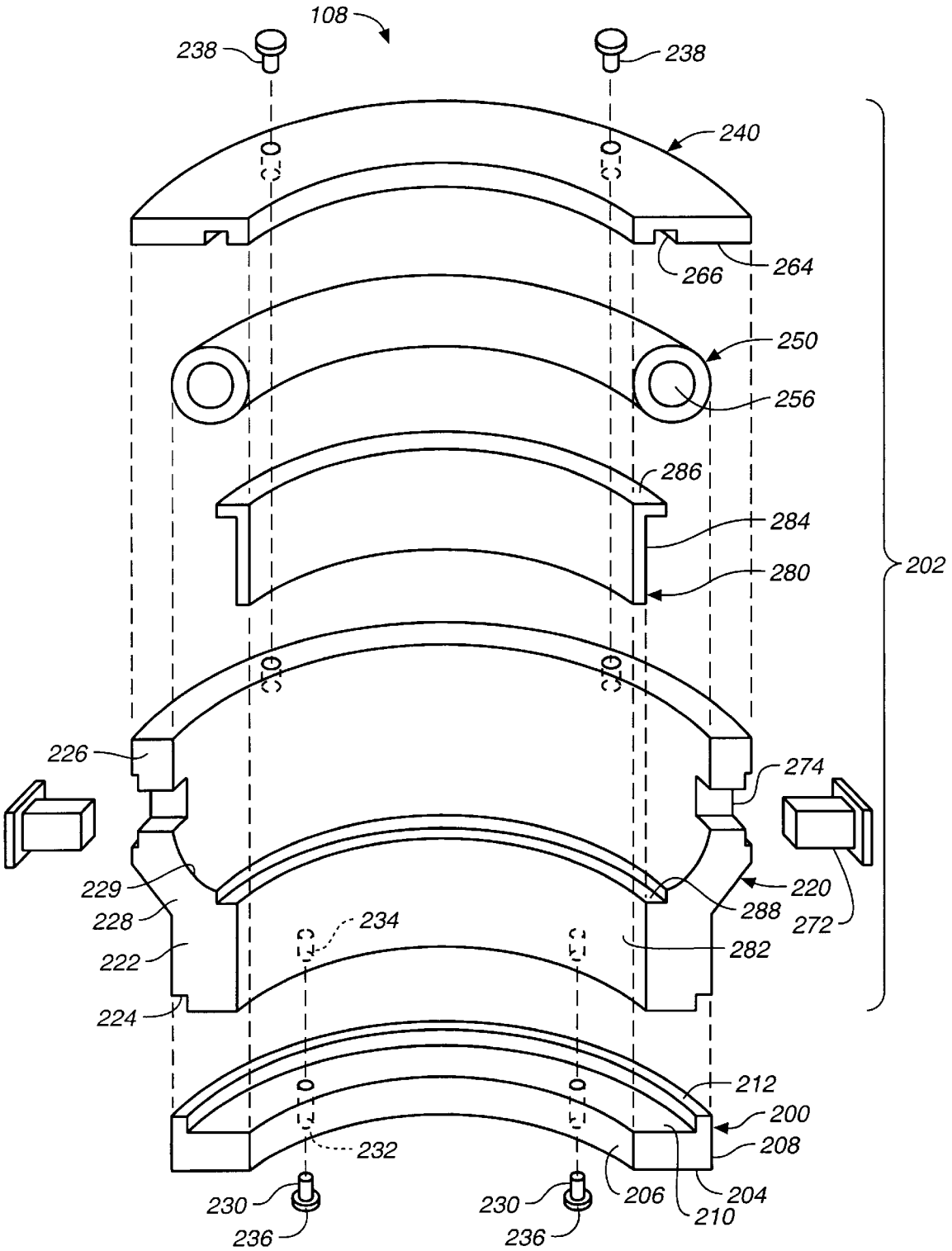
FIG. 5 is a schematic, exploded and partially cross-sectional view of the conditioning apparatus of the present invention.

Referring now to FIGS. 5, 6 and 7, the details of construction of conditioning ring 200 and positioning mechanism 202 will be described. The conditioning ring 200 may be an annular member having an annular conditioning surface 204, an inner wall 206, an outer wall 208, and a mounting surface 210. The mounting surface 210 is located opposite to and generally parallel with conditioning surface 204. An annular alignment flange 212 extends from the mounting surface 210. The alignment flange provides for alignment of conditioning ring 200 with positioning mechanism 202 as will be further described. Conditioning ring 200 may be a solid ring of stainless steel which is appropriately patterned on the lower portion thereof to provide conditioning surface 204. Alternatively, an abrasive material may be attached to or embedded in the lower portion of conditioning ring to form conditioning surface 204. For example, a nickel-coated diamond layer may be adhesively attached to the lower portion of the conditioning ring to form conditioning surface 204.

Positioning mechanism 202 is located around the periphery of housing assembly 102. The positioning mechanism 202 includes an annular rim 220, which is located about the outer circumferential surface 216 of housing support plate 110 and wall 116, and an annular cover ring 240, which is located over an upper surface 218 of housing support plate 110. To enable movement of conditioning ring 200 with respect to substrate receiving face 130, the positioning mechanism includes two opposed biasing assemblies. The biasing assemblies permit adjustable vertical-positioning of the conditioning ring relative to the polishing surface. One biasing assembly may be a flexible, inflatable annular bladder 250 which surrounds wall 116 of housing assembly 102. The bladder 250 may have a pressurizable core 256. The other biasing assembly may be a spring assembly 260 located between annular cover ring 240 and upper surface 218 of housing support plate 110. The spring assembly may include six to twelve coil springs 262 (only two are shown in FIG. 4) evenly spaced around the perimeter of housing support plate 110. The coil springs, as noted, extend between an underside 264 of cover ring 240 and upper surface 218 of housing support plate 110. To secure the springs within this space, a plurality of spring receiving pockets 266 are located in cover ring 240, and a plurality of spring-receiving cutouts 268 are located in upper surface 218 of housing support plate 110. Spring assembly 260 provides a force to urge the conditioning surface away from the polishing pad, whereas bladder 250 provides a variable force to bring the conditioning surface into contact with the polishing pad.

Rim 220 includes a lower mounting portion 222, an upper annular end portion 226 and a doglegged portion 228 extending therebetween. The lower mounting portion 222 includes a circumferential recess 224, and the inner surface of doglegged portion 228 includes a curved ledge 229. The conditioning ring 200 is attached to lower mounting portion 222 by securing annular alignment flange 212 in circumferential recess 224. A plurality of bolts 230 (only two are shown in the cross-sectional view of FIG. 5) pass through counter-bores 232 in conditioning ring 200 and into holes 234 in lower mounting portion 222 to secure the conditioning ring thereto. The heads 236 of the bolts are recessed within counter-bores 232 to ensure that they do not contact the polishing surface. The cover ring 240 is similarly connected to upper annular end 226 by a plurality of bolts 238 (only two are shown in FIG. 5).

To enable movement of positioning mechanism 202 with respect to housing assembly 102, bladder 250 is positioned, as noted, between wall 116 of housing assembly 102 and ledge 229 of the positioning member. The housing support plate 110 projects beyond wall 116 to form a projecting annular ledge 254. The curved ledge 229 of positioning mechanism 202 faces projecting annular ledge 254, and bladder 250 is positioned therebetween. When bladder 250 is suitably pressurized, it urges the positioning member, and the conditioning ring attached thereto, into contact with polishing surface 44.

The bladder 250 is connected to a fluid reservoir or pump (not shown) via a conduit 258 in housing support plate 110, channel 94 in drive shaft 74, rotary coupling 90 and line 92 (see FIG. 3). By pressurizing core 256 with a fluid, such as air, bladder 250 will expand. When the core is not pressurized, spring assembly 260, as noted, provides a force such that conditioning surface 204 is not in contact with the polishing pad. Thus, by controlling the pressure in core 256 of bladder 250, the conditioning surface 204 may be urged into contact with or away from the polishing surface.

During the operation of conditioning assembly 108, carrier head 100 will be positioned over the polishing surface 44, and one or both the polishing surface and the carrier head will rotate. The carrier head 100 also may oscillate in a radial slot 72 (FIG. 1) in the multi-head carousel 60 (FIG. 1), moving the substrate 10 and the conditioning surface 204 across the polishing surface 44. This motion may ensure that the substrate 10 is polished evenly and that the polishing surface 44 is conditioned evenly.

The engagement of conditioning surface 204 with polishing surface 44 will tend to impart a rotational motion between housing assembly 102 and conditioning assembly 108. To prevent rotation of the conditioning assembly with respect to the housing assembly, a plurality of rectangular detents 270 are formed in housing support plate 110. A plurality of set screws 272 extend through holes 274 in upper annular end portion 226 of rim 220 and into detents 270. The screws 272 and detents 270 provide a rotation restricting arrangement, specifically, a key and keyway connection, to allow up and down motion, but significantly restrict rotational motion, between the conditioning assembly and the housing assembly.

The motion of the carrier head 100 with respect to the polishing surface can also force rim 220 into contact with wall 116 of housing assembly 102. If this occurs, positioning mechanism 202 may catch against wall 116, thereby preventing proper operation of bladder 250. To eliminate this potential problem, the positioning member is provided with a sleeve 280 positioned adjacent to an inner surface 282 of lower mounting portion 222 of rim 220. The sleeve 280 includes a low-friction inner circumferential bearing surface 284 which contacts wall 116, and an outwardly-projecting flange 286 which is positioned in a corresponding annular ledge 288 in lower mounting portion 222 to connect the sleeve to the positioning rim. The sleeve may be formed of a low-friction material such as Delrin™.

As shown in FIG. 7, in operation, the bladder is pressurized to urge the positioning member downwardly, so the conditioning surface contacts the polishing surface. By varying the pressure in the bladder, the force exerted by the conditioning surface on the polishing surface may be varied. In addition, it may be noted that this force may be varied independently of the force by the substrate or retaining ring on the polishing surface. As shown in FIG. 6, to lift the conditioning surface from the polishing surface, the bladder is de-pressurized so that the force of the spring assembly can lift the conditioning surface from the polishing surface.

Figure 8:
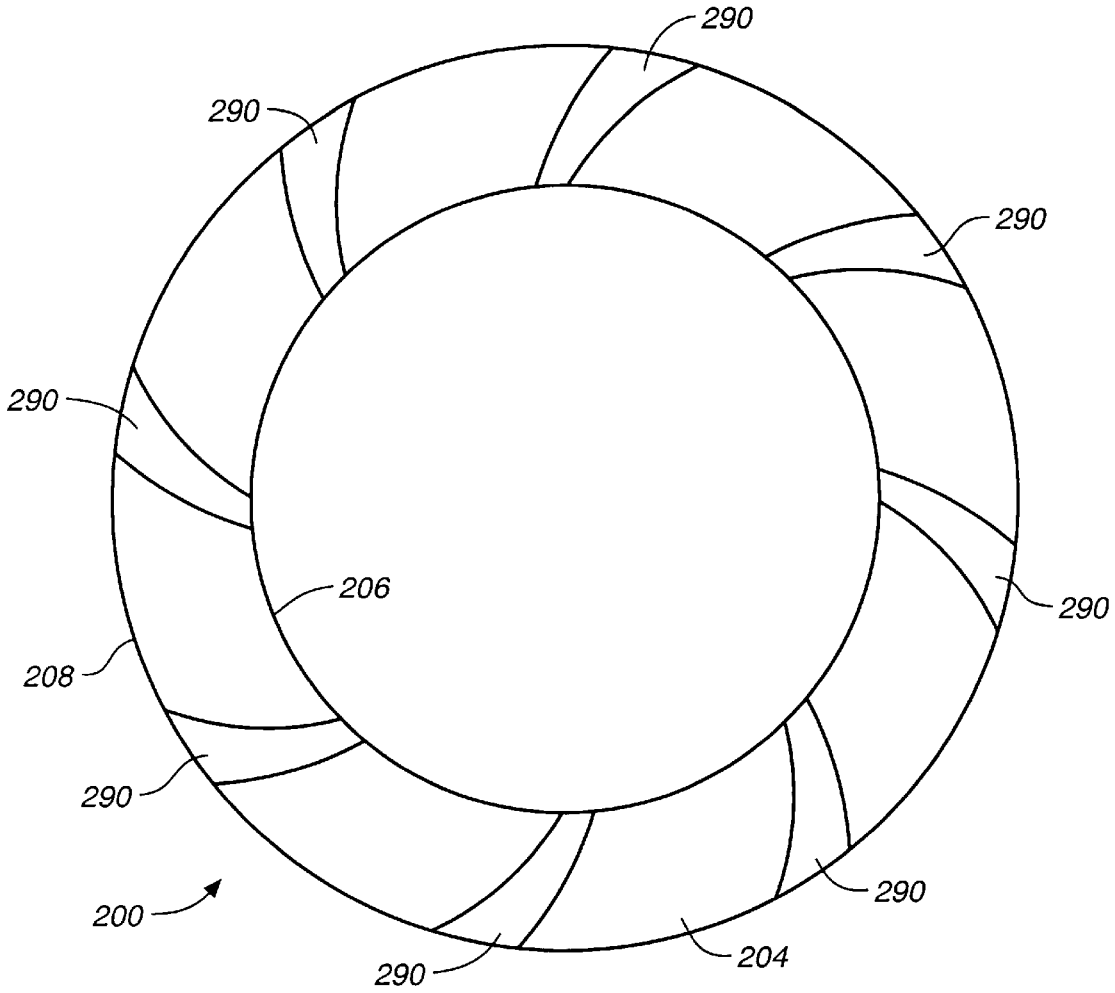
FIG. 8 is a schematic bottom view of the conditioning apparatus of the present invention, illustrating a conditioning surface.

Referring to FIG. 8, the conditioning surface 204 of conditioning ring 200 may have grooves or channels 290 formed therein. The channels 290 extend from outer wall 208 to inner wall 206. They provide for the distribution of slurry to substrate 10. Channels 290 may be arcuate shaped, with a decreasing cross-sectional dimension from the outer wall to the inner wall. As conditioning ring 200 is pressed against and moves across polishing pad 42, slurry is swept into channels 290 and funneled inwardly toward substrate 10. Without such slurry-distributing grooves, the conditioning ring might prevent the slurry from reaching the substrate, thus interfering with the polishing process.

The ability to adjust the positioning of the conditioning surface provides process flexibility for polishing surface conditioning. Specifically, conditioning surface 204 may be continuously positioned against the polishing surface as substrate 10 is being polished. Alternatively, it may be selectively positioned against the polishing surface as the substrate is being polished (by inflating or deflating the bladder to retract or extend the conditioning surface). Also, it may be positioned against the polishing surface when substrate polishing is not occurring. In this situation, the conditioning process occurs without simultaneous polishing of a substrate. Carrier head 100 thus provides a convenient platform for the conditioning mechanism.

Figure 9:
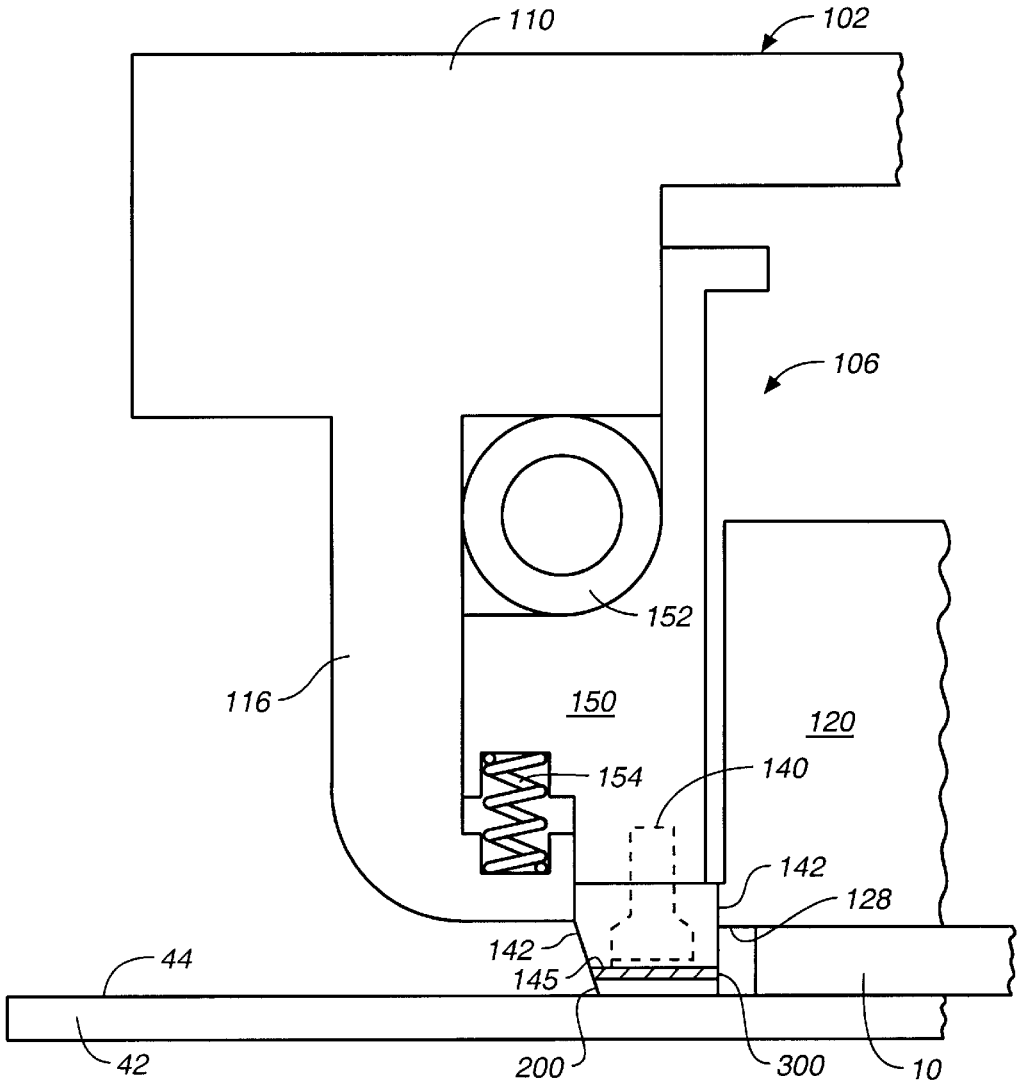
FIG. 9 is a cross-sectional view of a portion of a carrier in which a conditioning ring is connected to the carrier's retaining ring assembly.

Referring to FIG. 9, conditioning ring 200 may be connected to the bottom surface 145 of retaining ring 140. Conditioning ring 200 may be attached to retaining ring 140 in a manner similar to that shown in FIG. 6, or it may be attached by an adhesive layer 300. In this embodiment, no conditioning assembly is required, and the conditioning ring 200 is pressed against and removed from polishing surface 44 by the expansion and contraction, respectively, of bladder 152. In general, the bladder 152 should be inflated such that the surface pressure between the polishing surface 44 and the conditioning ring 200 equals the surface pressure between the polishing surface 44 and the substrate 10. When polishing pad 42 is a fixed abrasive pad, the surface pressure is typically 1–6 psi, and preferably is approximately 4 psi.

In most CMP processes, and especially processes in which fixed abrasive pads are used, the conditioning ring 200 should consist of a moderately flexible material having a textured surface. Fiber-reinforced epoxy materials (such as fiber-reinforced glass or carbon fiber) are acceptable, especially materials having woven structures, such as FR-4 material available from Allied Signal. When an FR-4 conditioning ring is used on a fixed abrasive pad, the pad will polish substrates at a relatively high removal rate (typically around 2500 Å/min). Materials such as plastics and ceramics also may be used in the conditioning ring, but plastics tend to be too flexible and ceramics too rigid to condition polishing pads effectively. When a plastic or ceramic ring is used on a fixed abrasive pad, the pad will polish substrates at a relatively low removal rate (typically around 1200–1500 Å/min).

In summary, a conditioning apparatus according to the present invention may include a conditioning ring which is connected to the carrier head. The conditioning ring may be connected to a surface of the carrier head's retaining ring assembly. The conditioning ring may be brought into contact with the polishing pad either continuously or intermittently. The polishing pad may be conditioned during substrate polishing.

The present invention has been described in terms of a preferred embodiment. The invention, however, is not limited to the embodiment depicted and described. For example, bladder 152 (as well as bladder 250) may be replaced by another pressure-generating source, such as a motorized lead screw assembly adapted to raise and lower outer flange 150, or a sealed pneumatic pressure chamber bounded by housing support plate 110, wall 116, inner flange 148, and outer flange 150. The scope of the invention is defined by the appended claims.

What is claimed is:

1. An apparatus for use in a chemical mechanical polishing system, comprising:

(a) a carrier having a substrate receiving surface to hold a substrate on a polishing surface;

(b) a conditioning surface formed as a part of said carrier to condition the polishing surface; and (c) two positioning mechanisms capable of operating independently of each other to press the substrate and the conditioning surface, respectively, against the polishing surface.

2. The apparatus of claim 1 wherein one of the positioning mechanisms is operable to move said conditioning surface between a first position not in contact with said polishing surface and a second position in contact with said polishing surface.

3. The apparatus of claim 2 wherein one of the positioning mechanisms includes a biasing assembly operable to bias said conditioning surface against said polishing surface.

4. The apparatus of claim 3 wherein said biasing assembly includes an inflatable bladder.

5. The apparatus of claim 2 wherein one of the positioning mechanisms includes a biasing assembly operable to bias said conditioning surface away from said polishing surface.

6. The apparatus of claim 5 wherein said biasing assembly includes a spring.

7. The apparatus of claim 1 further including a conditioner having said conditioning surface.

8. The apparatus of claim 7 further including a low-friction bearing surface disposed between said conditioner and said carrier.

9. The apparatus of claim 7 further including a rotation restricting member connecting said conditioner and said carrier.

10. The apparatus of claim 9 wherein said rotation restricting member includes a key and keyway connection between said carrier and said conditioner.

11. The apparatus of claim 1 wherein said conditioning surface extends around a perimeter of said carrier.

12. The apparatus of claim 1 wherein said conditioning surface has a channel to permit distribution of a slurry to the substrate.

13. The apparatus of claim 1 wherein the carrier is operable to move the substrate and the conditioning surface across the polishing surface.

14. A carrier head for use in a chemical mechanical polishing system, the carrier head comprising:

(a) a housing assembly having a substrate receiving surface to hold a substrate on a polishing surface;

(b) a conditioning member coupled to the housing assembly and operable to condition the polishing surface; and (c) two positioning mechanisms capable of operating independently of each other to press the substrate and the conditioning surface, respectively, against the polishing surface.

15. The carrier head of claim 14 further including a retaining member positioned near the substrate receiving surface to hold the substrate in position on the polishing surface.

16. The carrier head of claim 15 wherein the positioning mechanisms are operable to cause the substrate and the conditioning member to contact the polishing surface at different times.

17. The carrier head of claim 15 wherein said conditioning member is connected to a surface of the retaining member.

18. The carrier head of claim 14 wherein the carrier head is operable to move the substrate across the polishing surface.

19. A method of conditioning a polishing surface in a chemical mechanical polishing system while the polishing surface polishes a substrate, the method comprising:

(a) activating a positioning mechanism in a carrier assembly to press the substrate against the polishing surface; and (b) activating another positioning mechanism in the carrier assembly to press a conditioning surface against the polishing surface to condition the polishing surface.

* * * * *